US009183785B2

(12) United States Patent
Kim

(10) Patent No.: US 9,183,785 B2
(45) Date of Patent: Nov. 10, 2015

(54) ORGANIC LIGHT EMITTING DISPLAY DEVICE AND METHOD FOR DRIVING THE SAME

(71) Applicant: LG Display Co., Ltd., Seoul (KR)

(72) Inventor: Hyung-Jung Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/558,883

(22) Filed: Dec. 3, 2014

(65) Prior Publication Data

US 2015/0154913 A1 Jun. 4, 2015

(30) Foreign Application Priority Data

Dec. 4, 2013 (KR) ..... 10-2013-0150057

(51) Int. Cl.
*G09G 5/10* (2006.01)
*G09G 3/32* (2006.01)

(52) U.S. Cl.
CPC ..... *G09G 3/3291* (2013.01); *G09G 3/3233* (2013.01); *G09G 3/3258* (2013.01); *G09G 2300/0439* (2013.01); *G09G 2310/0202* (2013.01); *G09G 2310/027* (2013.01); *G09G 2310/0235* (2013.01); *G09G 2310/0278* (2013.01); *G09G 2320/0219* (2013.01); *G09G 2320/0276* (2013.01); *G09G 2320/0295* (2013.01); *G09G 2320/043* (2013.01); *G09G 2320/0626* (2013.01); *G09G 2360/16* (2013.01)

(58) Field of Classification Search
CPC ..... G09G 3/3283; G09G 2300/0861; G09G 2320/045; G09G 2330/026
USPC ..... 345/48, 76–104, 204, 214, 617, 345/690–692; 324/754.28, 760.01
See application file for complete search history.

(56) References Cited

U.S. PATENT DOCUMENTS

2005/0110420 A1 5/2005 Arnold et al.
2006/0007249 A1 * 1/2006 Reddy et al. ..... 345/690
2006/0290648 A1 * 12/2006 Yun et al. ..... 345/102

(Continued)

FOREIGN PATENT DOCUMENTS

EP 1 622 119 A1 2/2006
EP 2 453 433 A2 5/2012

(Continued)

OTHER PUBLICATIONS

Communication dated Feb. 20, 2015 from the European Patent Office in counterpart European application No. 14195580.7-1903.

*Primary Examiner* — Prabodh M Dharia
(74) *Attorney, Agent, or Firm* — Morgan, Lewis & Bockius LLP

(57) ABSTRACT

An organic light emitting display device comprising a display panel and a panel driver is disclosed. The display panel includes pixels and sensing lines respectively coupled to the pixels. Each pixel includes an organic light emitting device and a driving transistor to control a current flow in the organic light emitting device. The panel driver is configured to receive an input image data, to generate a sensing data by sensing a characteristic variation of the driving transistor, to generate a peak luminance data to limit peak luminance of an input image, to generate a corrected data by correcting the input image data based on the sensing data, to convert the corrected data to a data voltage based on a plurality of reference gamma voltages set based on the peak luminance data, and to supply the data voltage to the pixels.

27 Claims, 6 Drawing Sheets

(56) References Cited

U.S. PATENT DOCUMENTS

| | | | | |
|---|---|---|---|---|
| 2007/0080905 | A1* | 4/2007 | Takahara | 345/76 |
| 2007/0236431 | A1 | 10/2007 | Tada et al. | |
| 2008/0204438 | A1* | 8/2008 | Song et al. | 345/207 |
| 2008/0238833 | A1 | 10/2008 | Hioki et al. | |
| 2009/0140959 | A1 | 6/2009 | Nam et al. | |
| 2009/0189924 | A1* | 7/2009 | Ogura | 345/690 |
| 2010/0045334 | A1* | 2/2010 | Gardner et al. | 324/770 |
| 2010/0149226 | A1 | 6/2010 | Byun et al. | |
| 2010/0214309 | A1* | 8/2010 | Bae et al. | 345/589 |
| 2010/0312625 | A1* | 12/2010 | Miller et al. | 705/14.5 |
| 2011/0032277 | A1* | 2/2011 | Lee et al. | 345/690 |
| 2011/0063283 | A1* | 3/2011 | Ryu et al. | 345/214 |
| 2011/0069096 | A1* | 3/2011 | Li et al. | 345/690 |
| 2011/0084987 | A1* | 4/2011 | Kim et al. | 345/690 |
| 2011/0096101 | A1* | 4/2011 | Lee et al. | 345/690 |
| 2011/0102418 | A1* | 5/2011 | Park | 345/214 |
| 2011/0122119 | A1 | 5/2011 | Bae et al. | |
| 2011/0227505 | A1 | 9/2011 | Park et al. | |
| 2012/0147062 | A1* | 6/2012 | Seo et al. | 345/690 |
| 2012/0147065 | A1* | 6/2012 | Byun et al. | 345/690 |
| 2012/0147291 | A1* | 6/2012 | Seo | 349/62 |
| 2013/0038621 | A1* | 2/2013 | Choi et al. | 345/589 |
| 2013/0147690 | A1 | 6/2013 | Kim et al. | |
| 2013/0147694 | A1 | 6/2013 | Kim et al. | |
| 2013/0162617 | A1 | 6/2013 | Yoon et al. | |
| 2014/0139409 | A1* | 5/2014 | Sato et al. | 345/76 |

FOREIGN PATENT DOCUMENTS

| | | | |
|---|---|---|---|
| KR | 10-0846790 | B1 | 7/2008 |
| KR | 10-2009-0046983 | A | 5/2009 |
| KR | 10-2010-0047505 | A | 5/2010 |
| KR | 10-2011-0057534 | A | 6/2011 |
| KR | 10-1073226 | B1 | 10/2011 |
| KR | 10-2012-0045252 | A | 5/2012 |
| KR | 10-2012-0076215 | A | 7/2012 |
| KR | 10-2013-0066449 | A | 6/2013 |
| KR | 10-2013-0066450 | A | 6/2013 |
| KR | 10-2013-0074147 | A | 7/2013 |
| WO | 2007/018381 | A1 | 2/2007 |

* cited by examiner

A A

ORGANIC LIGHT EMITTING DISPLAY DEVICE AND METHOD FOR DRIVING THE SAME

This application claims the benefit of the Korean Patent Application No. 10-2013-0150057 filed in Korea on Dec. 4, 2013, which is hereby incorporated by reference for all purposes as if fully set forth herein.

BACKGROUND OF THE INVENTION

1. Field of the Invention

The present invention relates to an organic light emitting display device and a method for driving the same.

2. Discussion of the Related Art

Generally, an organic light emitting display device is a self light-emitting device that displays images by allowing an organic light emitting device to emit light through recombination of electrons and holes. This organic light emitting display device has received much attention as a next generation flat panel display device, owing to its advantages of fast response speed, low power consumption, and excellent viewing angle characteristic based on self-light emission.

The organic light emitting display device of the related art includes a plurality of pixels formed in pixel regions defined by the crossings between a plurality of scan control lines and a plurality of data lines. Each of the plurality of pixels includes an organic light emitting device and a driving transistor for controlling a current flowing in the organic light emitting device.

According to the organic light emitting display device of the related art, as such characteristic deviations as a threshold voltage Vth and mobility of the driving transistor are generated for each pixel due to a process deviation, the amount of current for driving the organic light emitting device is varied. For this reason, a luminance deviation is generated between the pixels. To solve this problem, the Korean laid-open patent No. 10-2013-0066449 having a counterpart of US 2013/0147694 A1 (hereinafter, collectively referred to as the "related art reference") discloses the external compensation technology for compensating for a characteristic variation of a driving transistor included in each pixel through a data correction. In other words, according to the related art reference, the characteristic variation of the driving transistor is compensated for by externally sensing a characteristic variation of the driving transistor included in each pixel, generating a sensing data, calculating a compensation value corresponding to the sensing data, and then using the compensation value in determining the pixel data to be supplied to the corresponding pixel.

However, the external compensation technology disclosed in the related art reference has a problem in that a characteristic variation of the driving transistor cannot be compensated for if the compensation value based on the characteristic variation of the driving transistor is more than a set threshold compensation value. In other words, since there is a set limit in the compensation value for compensating for the characteristic variation of the driving transistor through data correction, as shown in graph (a) of FIG. 1, the characteristic variation of the driving transistor may be compensated for to the extent that the compensation value for each pixel is less than a threshold compensation value $V_{Limit}$. However, as shown in graph (b) of FIG. 1, the compensation value for each pixel exceeding the threshold compensation value $V_{Limit}$ is limited by the threshold compensation value $V_{Limit}$, whereby the characteristic variation of the driving transistor may not be adequately compensated for.

Accordingly, the organic light emitting display device disclosed in the related art reference has a problem in that the driving transistor is degraded when the organic light emitting display device is driven for a long period of time.

SUMMARY OF THE INVENTION

Accordingly, the present invention is directed to an organic light emitting display device and a method for driving the same, which substantially obviate one or more problems due to limitations and disadvantages of the related art.

An object of the present invention is to provide an organic light emitting display device and a method for driving the same, in which the degradation of a driving transistor caused by being driven for a long period of time may be reduced.

Additional features and advantages of the invention will be set forth in the description which follows, and in part will be apparent from the description, or may be learned by practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an organic light emitting display device includes: a display panel including a plurality of pixels and a plurality of sensing lines respectively coupled to the pixels, each of the pixels including an organic light emitting device and a driving transistor to control a current flow in the organic light emitting device; and a panel driver configured to receive an input image data for at least one of the pixels, to generate a sensing data by sensing a characteristic variation of the driving transistor in the at least one of the pixels through a corresponding one of the sensing lines, to calculate a frame representative value based on the input image data, to generate a peak luminance data to limit peak luminance of an input image based on the frame representative value, to generate a corrected data for the at least one of the pixels by correcting the input image data based on the sensing data, to convert the corrected data to a data voltage based on a plurality of reference gamma voltages set based on the peak luminance data, and to supply the data voltage to the at least one of the pixels.

In another aspect, an organic light emitting display device includes: a display panel including a plurality of scan lines, a plurality of data lines crossing the scan lines, a plurality of pixels at the crossings of the scan lines and data lines, and a plurality of sensing lines respectively coupled to the pixels, at least one of the pixels including an organic light emitting device and a driving transistor to control a current flow in the organic light emitting device; a timing controller configured to generate a scan control signal and a data control signal, and configured to receive an input image data for the at least one of the pixels and a sensing data for the at least one of the pixels, to generate a peak luminance data based on the input image data, and to generate a corrected data for the at least one of the pixels based on the sensing data; a row driver configured to supply first scan pulses to the scan lines and second scan pulses to the sensing control lines based on the scan control signal; a reference gamma voltage supply configured to generate the plurality of reference gamma voltages based on the peak luminance data; and a column driver coupled to the data lines and sensing lines, and configured to generate the sensing data by sensing the characteristic variation of the driving transistor in the at least one of the pixels through a corresponding one of the sensing lines, to convert the corrected data to the data voltage based on the plurality of reference gamma voltages, and to supply the data voltage to the at least one of the pixels.

In yet another aspect, a method for driving an organic light emitting display device including a plurality of pixels and a plurality of sensing lines respectively coupled to the pixels, each of the pixels including an organic light emitting device and a driving transistor for controlling a current flowing in the organic light emitting device is disclosed, where the method includes: generating a sensing data for at least one of the pixels by sensing a characteristic variation of the driving transistor of the at least one of the pixels through a corresponding one of the sensing lines; calculating a frame representative value based on an input image data for the at least one of the pixels; determining a peak luminance data to limit peak luminance of an input image based on the frame representative value and the sensing data; determining a corrected data for the at least one of the pixels by correcting the input image data based on the sensing data; generating a plurality of reference gamma voltages based on the peak luminance data; converting the corrected data to a data voltage based on the plurality of reference gamma voltages; and supplying the data voltage to the at least one of the pixels.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate example embodiments of the invention and together with the description serve to explain the principle of the invention. In the drawings.

DETAILED DESCRIPTION OF THE EXAMPLE EMBODIMENTS

Reference will now be made in detail to the embodiments of the present invention, examples of which are illustrated in the accompanying drawings. Wherever possible, the same reference numbers will be used throughout the drawings to refer to the same or like parts.

Terminologies disclosed in this specification should be understood as follows.

Unless otherwise specified, it is to be understood that the singular expression used in this specification includes the plural expression unless defined differently in the context. The terminologies such as "first" and "second" are intended to identify one element from another element, and it is to be understood that the scope of the present invention should not be limited by these terminologies.

Also, unless otherwise specified, it is to be understood that the terminologies such as "include" and "has" are intended so as not to exclude the presence or optional possibility of one or more additional features, numbers, steps, operations, elements, parts or their combinations.

Furthermore, unless otherwise specified, it is to be understood that the terminology "at least one" is intended to include all combinations that may be suggested from one or more related items. For example, "at least one of a first item, a second item, and a third item" means combination of all the items that may be suggested from two or more of the first item, the second item and the third item, as well as each of the first item, the second item and the third item.

Hereinafter, an organic light emitting display device according to example embodiments of the present invention and a method for driving the same will be described with reference to the accompanying drawings.

Figure 1:
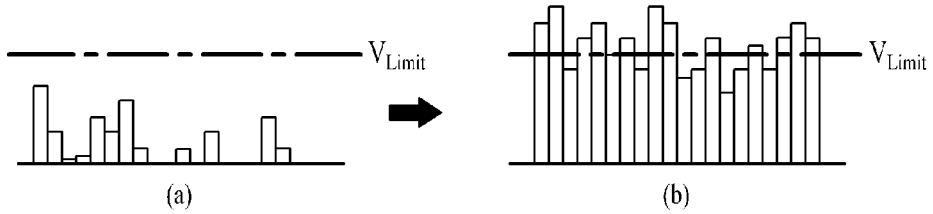
FIG. 1 Related Art
FIG. 1 is a diagram illustrating a limit on a compensation value in an organic light emitting display device of the related art.
Figure 2:
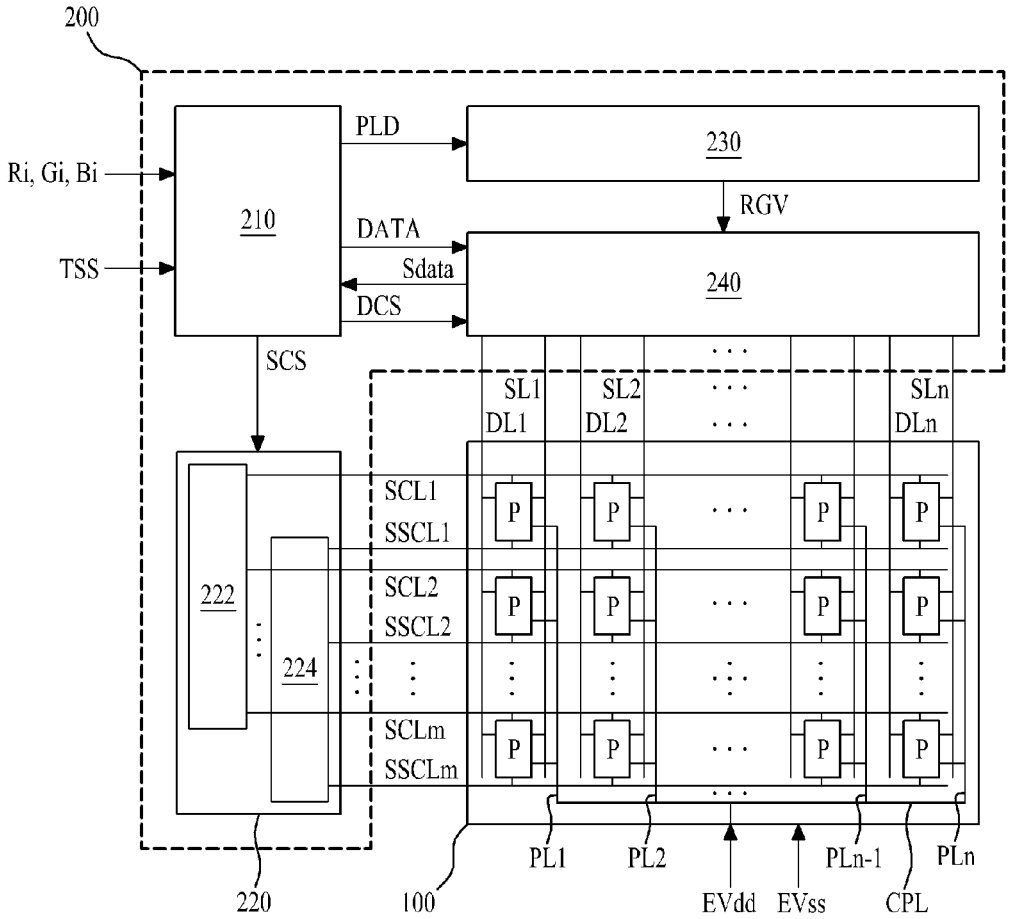
FIG. 2 is a diagram illustrating an organic light emitting display device according to an example embodiment of the present invention.
Figure 3:
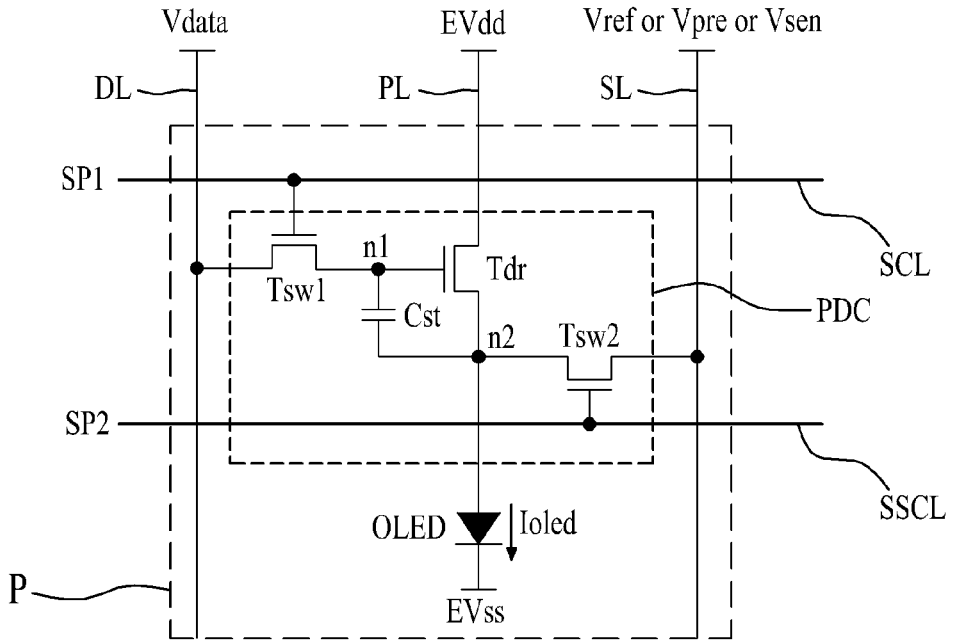
FIG. 3 is a diagram illustrating an example structure of each pixel shown in FIG. 2.

FIG. 2 is a diagram illustrating an organic light emitting display device according to an example embodiment of the present invention, and FIG. 3 is a diagram illustrating an example structure of each pixel shown in FIG. 2.

As shown in FIGS. 2 and 3, the organic light emitting display device according to the example embodiment of the present invention includes a display panel 100 and a panel driver 200.

The display panel 100 includes a plurality of pixels P each having an organic light emitting device (OLED) and a pixel driving circuit (PDC), which includes a driving transistor Tdr for controlling a current flowing in the organic light emitting device (OLED), and signal lines for defining a pixel region where each of the plurality of pixels P is formed and for supplying a driving signal to the pixel driving circuit (PDC).

The signal lines may include the first to m-th (m is a positive integer) scan control lines SCL1 to SCLm, the first to m-th sensing control lines SSCL1 to SSCLm, the first to n-th (n is a positive integer greater than m) data lines DL1 to DLn, the first to n-th sensing lines SL1 to SLn, a plurality of first driving power lines PL1 to PLn, and at least one second driving power line (not shown).

The first to m-th scan control lines SCL1 to SCLm may be formed to have constant intervals and to extend along a first direction of the display panel 100, that is, the horizontal direction in this example.

The first to m-th sensing control lines SSCL1 to SSCLm may be formed at constant intervals to be parallel with the scan control lines SCL1 to SCLm.

The first to n-th data lines DL1 to DLn may be formed to have constant intervals and to extend along a second direction of the display panel 100, that is, the vertical direction in this example, thereby crossing the scan control lines SCL1 to SCLm and the sensing control lines SSCL1 to SSCLm, respectively.

The first to n-th sensing lines SL1 to SLn may be formed at constant intervals to be parallel with the data lines DL1 to DLn.

The plurality of first driving power lines PL1 to PLn may be formed at constant intervals to be parallel with the data lines DL1 to DLn, as shown in FIGS. 2 and 3. Alternatively, the plurality of first driving power lines PL1 to PLn may be formed at constant intervals to be parallel with the scan control lines SCL1 to SCLm. Each of the plurality of first driving power lines PL1 to PLn is connected to a driving power supply (not shown) and supplies a first driving power EVdd supplied from the driving power supply (not shown) to each pixel P.

The respective first driving power lines PL1 to PLn may commonly be connected to first driving power common line CPL formed above and/or below on the display panel 100. In this case, the first driving power common line CPL is connected to a driving power supply (not shown) and supplies the first driving power EVdd supplied from the driving power supply to each of the plurality of first driving power lines PL1 to PLn.

The at least one second driving power line may be formed on an entire surface of the display panel 100 or may be formed at a constant interval to be parallel with either the data lines DL1 to DLn or the scan control lines SCL1 to SCLm. This second driving power line provides each pixel P with a second driving power EVss supplied from the driving power supply. The second driving power line may electrically be grounded to a case (or cover) of a metal material constituting the organic light emitting display device, or may supply a common voltage different from the ground voltage. In this example, the at least one second driving power line provides each pixel P with a ground power.

Each of the plurality of pixels P is formed in each pixel region defined by a crossing between a respective one of the first to m-th scan control lines SCL1 to SCLm and a respective one of the first to n-th data lines DL1 to DLn. In this example, each of the plurality of pixels P may be any one of a red pixel, a green pixel, a blue pixel and a white pixel. One unit pixel displaying one unit image may include a red pixel, a green pixel, a blue pixel and a white pixel, which are adjacent to one another, or may include a red pixel, a green pixel and a blue pixel.

Each of the plurality of pixels P may include a pixel driving circuit PDC and an organic light emitting device OLED.

The pixel driving circuit PDC may include a first switching transistor Tsw1, a second switching transistor Tsw2, a driving transistor Tdr, and a capacitor Cst. In this case, the transistors Tsw1, Tsw2 and Tdr are thin film transistors (TFTs), and their examples may include a-Si TFTs, poly-Si TFTs, Oxide TFTs, and organic TFTs.

The first switching transistor Tsw1 is switched on or off by a first scan pulse SP1, and outputs a data voltage Vdata supplied to the data line DL to node n1 (i.e., to the gate of the driving transistor Tdr and to the first electrode of the capacitor Cst). To this end, the first switching transistor Tsw1 includes a gate electrode connected to its adjacent scan control line SCL, a source electrode connected to its adjacent data line DL, and a drain electrode connected to a first node n1, which is a gate electrode of the driving transistor Tdr.

The second switching transistor Tsw2 is switched on or off by a second scan pulse SP2, and supplies a voltage Vref or Vpre supplied to a sensing line SL to a second node n2, which is a source electrode of the driving transistor Tdr as well as the second electrode of the capacitor Cst. To this end, the second switching transistor Tsw2 includes a gate electrode connected to its adjacent sensing control line SSCL, a source electrode connected to its adjacent sensing line SL, and a drain electrode which is connected to the second node n2.

The capacitor Cst includes first and second electrodes connected between the gate and source electrodes of the driving transistor Tdr, that is, the first and second nodes n1 and n2. The first electrode of the capacitor Cst is connected to the first node n1, and the second electrode of the capacitor Cst is connected to the second node n2. The capacitor Cst charges to a difference voltage, representing the difference between the voltages respectively supplied to the first and second nodes n1 and n2 in accordance with switching of the first and second switching transistors Tsw1 and Tsw2. The capacitor Cst then switches the driving transistor Tdr on or off in accordance with the charged voltage.

The driving transistor Tdr is turned on by the charged voltage of the capacitor Cst to control the amount of current flowing from the first driving power line PL to the organic light emitting device OLED. To this end, the driving transistor Tdr includes the gate electrode connected to the first node n1, the source electrode connected to the second node n2, and the drain electrode connected to the first driving power line PL.

The organic light emitting device OLED emits light in accordance with the data current Ioled supplied from the driving transistor Tdr, thereby emitting single colored light having luminance corresponding to the data current Ioled. To this end, the organic light emitting device OLED includes a first electrode (for example, an anode electrode) connected to the second node n2, that is the source electrode of the driving transistor Tdr, an organic layer (not shown) formed on the first electrode, and a second electrode (for example, a cathode electrode) connected to the organic layer. The organic layer may have a multi-layer structure of a hole transporting layer, an organic light emitting layer, and an electron transporting layer. Alternatively, the organic layer may have other structures, such as a multi-layer structure of a hole injecting layer, a hole transporting layer, and organic light emitting layer, and electron transporting layer, and an electron injecting layer. Moreover, the organic layer may further include a function layer for improving the light emitting efficiency and/or lifespan of the organic light emitting device OLED. The second electrode may be the second driving power line formed on the organic layer, or may be an additional layer formed on the organic layer and connected to the second driving power line.

The panel driver 200 operates the display panel 100 in a sensing mode or in a display mode. In this case, the sensing mode may be performed per setting by a user, set period, or blank period of at least one frame displaying image.

The panel driver 200 generates sensing data Sdata by sensing one or more characteristic variations (for example, the threshold voltage and/or mobility) of the driving transistor Tdr included in each pixel P through each of the first to n-th sensing lines SL1 to SLn. Then, the panel driver 200 generates corrected data DATA by correcting input image data Ri, Gi and Bi on the basis of the sensing data Sdata. The panel driver 200 also generates a peak luminance data PLD for limiting the peak luminance of the input images on the basis of a frame representative value calculated from the input image data Ri, Gi and Bi, and the sensing data Sdata. Next, the panel driver 200 converts the corrected data DATA to a data voltage Vdata by using a plurality of reference gamma voltages RGV generated on the basis of the peak luminance data PLD and then supplies the converted data voltage Vdata to the corresponding pixel P. In other words, to individually compensate for the characteristic variance of the driving transistors Tdr included in each pixel P, the panel driver 200 senses the characteristic variation of each of the driving transistors Tdr through the corresponding one of the sensing lines SL1 to SLn, uses the sensed characteristic variance of each of the driving transistors Tdr to determine a luminance compensation data and a grayscale compensation data. The panel driver 200 then uses the luminance compensation data in determining the peak luminance data PLD to control the peak luminance of the input images. The panel driver 200 also uses the grayscale compensation data along with the input data Ri, Gi and Bi to determine the corrected data DATA for driving each pixel. Accordingly, the panel driver 200 is capable of extending the compensation range of the external compensation data while compensating for the characteristic variation of the driving transistor Tdr of each pixel P. In this case, the luminance compensation data may be generated on the basis of a common minimum amount of characteristic variation among the driving transistors Tdr of all the sensed pixels P. The grayscale compensation data may be generated on the basis of the additional amount of characteristic variation above the common minimum amount, obtained by subtracting the common minimum amount of characteristic variation from the total characteristic variation amount of the driving transistor Tdr in each of the sensed pixels P.

The panel driver 200 may include a timing controller 210, a row driver 220, a reference gamma voltage supply 230, and a column driver 240.

The timing controller 210 controls the row driver 220 and the column driver 240 in a sensing mode or a display mode by respectively generating a scan control signal SCS to control driving of the row driver 220 and a data control signal DCS to control driving of the column driver 240 on the basis of a timing synchronization signal TSS which is input from an external source. Also, the timing controller 210 generates the corrected data DATA and the peak luminance data PLD on the basis of the sensing data Sdata provided from the column driver 240 during the sensing mode, and provides the corrected data DATA to the column driver 240 and the peak luminance data PLD to the reference gamma supply 230.

The row driver 220 sequentially generates first scan pulses SP1 in response to the scan control signal SCS supplied from the timing controller 210 and sequentially supplies the generated first scan pulses SP1 to the first to m-th scan control lines SCL1 to SCLm. At the same time, the row driver 220 also sequentially generates second scan pulses SP2 in response to the scan control signal SCS and sequentially supplies the generated second scan pulses SP2 to the first to m-th sensing control lines SSCL1 to SSCLm. In this case, the scan control signal SCS may include a start signal and one or more clock signals.

The row driver 220 according to one example embodiment may include a scan line driver 222 and a sensing line driver 224.

The scan line driver 222 is connected to one or both ends of each of the first to m-th scan control lines SCL1 to SCLm. The scan line driver 222 generates the first scan pulses SP1, which are sequentially shifted on the basis of the scan control signal SCS, and then sequentially supplies the generated first scan pulses SP 1 to the first to m-th scan control lines SCL1 to SCLm.

The sensing line driver 224 is connected to one or both ends of each of the first to m-th sensing control lines SSCL1 to SSCLm. The sensing line driver 224 generates the second scan pulses SP2, which are sequentially shifted on the basis of the scan control signal SCS, and then sequentially supplies the generated second scan pulses SP2 to the first to m-th sensing control lines SSCL1 to SSCLm. The sensing line driver 224 may generate the second scan pulses SP2 in accordance with the scan control signal SCS supplied to the scan line driver 222 and one or more other scan control signals. Also, one scan control line SCL and one sensing control line SSCL are arranged in one pixel P, wherein the scan control line SCL and the sensing control line SSCL may be formed to be connected with each other. In this case, any one of the scan line driver 222 and the sensing line driver 224 may be omitted.

The row driver 220 may be formed directly on the display panel 100 together with the process of forming a thin film transistor of each pixel P, or may be formed in the form of one or more integrated circuits (ICs), whereby the row driver 220 may be connected to one or both ends of each of the scan control line SCL and the sensing control line SSCL.

The reference gamma voltage supply 230 generates a plurality of reference gamma voltages RGV, which are different from one another and have a voltage level for limiting the peak luminance of the input images in accordance with the peak luminance data PLD supplied from the timing controller 210. In other words, the reference gamma voltage supply 230 sets a voltage level of each of the high and low potential voltages and at least one middle voltage, which are supplied from a power supply (not shown). The gamma voltage supply 230 then generates a plurality of reference gamma voltages RGV having their respective voltage levels different from one another through a voltage distribution between the low potential voltage and the high potential voltage, and supplies the generated reference gamma voltages RGV to the column driver 240. At this time, the reference gamma voltage supply 230 may generate a plurality of common reference gamma voltages RGV commonly used in each pixel of the unit pixel. Alternatively, the gamma voltage supply 230 may generate a plurality of reference gamma voltages RGV per color, which are used individually (or independently) in each pixel of the unit pixel. The reference gamma voltage supply 230 may be provided as a programmable gamma integrated circuit (IC).

The column driver 240 is connected to each of the first to n-th data lines DL1 to DLn and to each of the first to n-th sensing lines SL1 to SLn. The column driver 240 operates in a sensing mode or a display mode in accordance with the mode control of the timing controller 210.

In case of the sensing mode, the column driver 240 generates sensing data Sdata by sensing one or more characteristic variations of the driving transistor Tdr included in each pixel P in response to a data control signal DCS of the sensing mode supplied from the timing controller 210 and provides the generated sensing data Sdata to the timing controller 210. In case of the display mode, in accordance with the data control signal DCS of the display mode supplied from the timing controller 210, the column driver 240 converts the corrected data DATA, which is supplied from the timing controller 210 in a unit of a horizontal line, to a data voltage Vdata by using the plurality of reference gamma voltages RGV supplied from the reference gamma voltage supply 230. Then, the column driver 240 supplies the converted data voltage Vdata to the corresponding data lines DL1 to DLn. At the same time, the column driver 240 supplies the reference voltage Vref to each of the first to n-th sensing lines SL1 to SLn.

Figure 4:
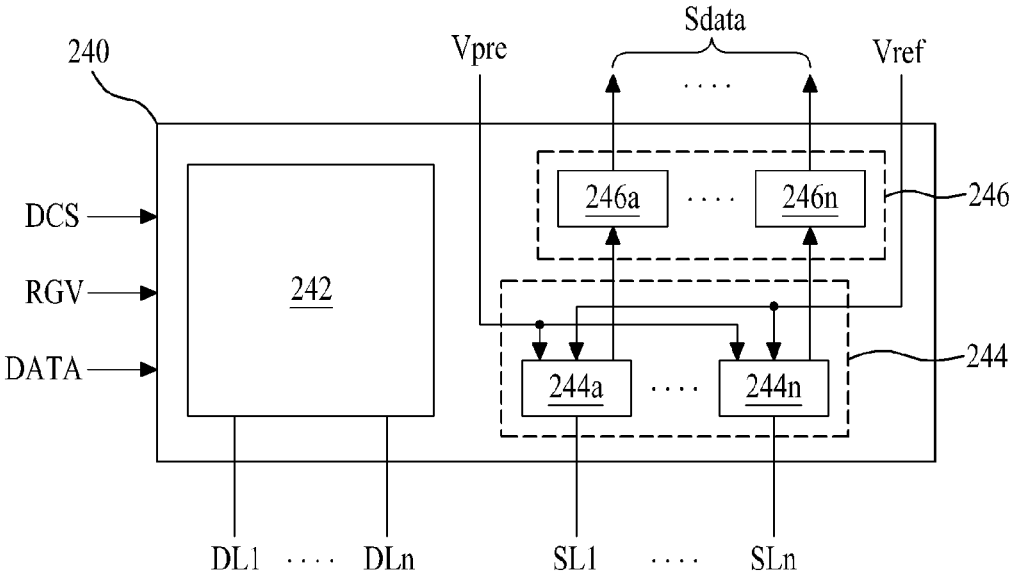
FIG. 4 is a block diagram illustrating an example column driver according to the present invention, which is shown in FIG. 2.

The column driver 240 according to one example, as shown in FIG. 4, includes a data driver 242, a switching unit 244, and a sensing unit 246.

The data driver 242 converts the corrected data DATA which are supplied from the timing controller 210 or pixel data for sensing to the data voltage Vdata and then respectively supplies the converted data voltage Vdata to the first to n-th data lines DL1 to DLn in response to the data control signal DCS supplied from the timing controller 210 in accordance with the display mode or the sensing mode. In other words, the data driver 242 samples the data DATA of each pixel, which are input in a unit of one horizontal line, in accordance with the data control signal DCS. Then, the data driver 242 selects a gamma voltage corresponding to a grayscale value of the sampling data from the plurality of reference gamma voltages RGV as the data voltage Vdata and then supplies the selected voltage Vdata to the data line DL of each pixel P.

The switching unit 244 supplies a reference voltage Vref, which is externally supplied, to each of the first to n-th sensing lines SL1 to SLn in response to the data control signal DCS supplied from the timing controller 210 during the display mode. The switching unit 244 also supplies a pre-charging voltage Vpre, which is externally supplied, to each of the first to n-th sensing lines SL1 to SLn in response to the data control signal DCS supplied from the timing controller 210 during the sensing mode, and then resets each of the first to n-th sensing lines SL1 to SLn to the pre-charging voltage Vpre, whereby each of the first to n-th sensing lines SL1 to SLn is connected to the sensing unit 246. To this ends, the switching unit 244 according to one example illustrated in FIG. 4 may include the first to n-th selectors 244*a* to 244*n* each connected to a corresponding one of the first to n-th sensing lines SL1 to SLn and the sensing unit 246, wherein the selectors 244*a* to 244*n* may be multiplexers.

The sensing unit 246 is connected to the first to n-th sensing lines SL1 to SLn through the switching unit 244 and senses the voltage of each of the first to n-th sensing lines SL1 to SLn during the sensing mode. The sensing unit then generates sensing data Sdata corresponding to the sensed voltage and provides the generated sensing data Sdata to the timing controller 210. To this end, as illustrated in FIG. 4, the sensing unit 246 may include the first to n-th analog-to-digital converters 246*a* to 246*n*, which are respectively connected to the first to n-th sensing lines SL1 to SLn through the switching unit 244 and perform analog-to-digital conversion of the sensed voltage to generate the sensing data Sdata.

Figure 5:
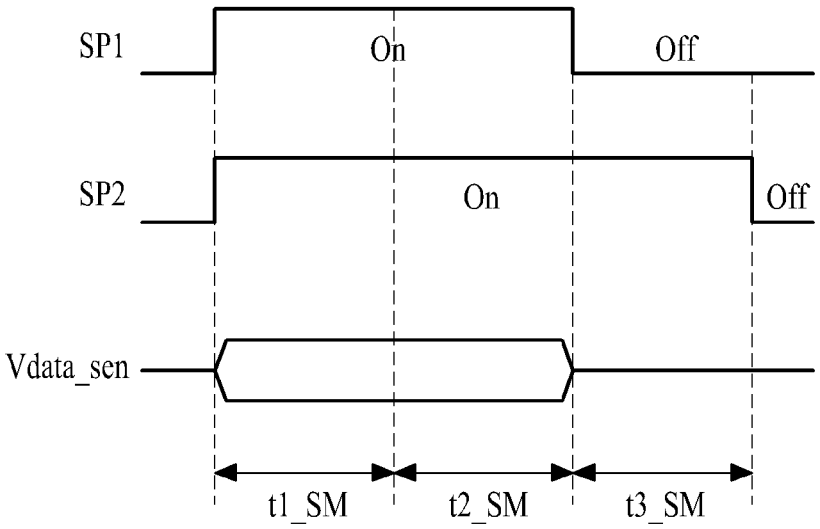
FIG. 5 is a waveform diagram illustrating a driving waveform during a sensing mode of an organic light emitting display device according to the example embodiment of the present invention.

FIG. 5 is a waveform diagram illustrating a driving waveform during a sensing mode of an organic light emitting display device according to the example embodiment of the present invention.

As shown in FIGS. 2 to 5, during the sensing mode, the panel driver 200 operates the driving transistor Tdr in each pixel P of the display panel 100 in a source follow mode to sense the characteristic variation of the driving transistor Tdr. To this end, the aforementioned timing controller 210 generates the data control signal DCS and the scan control signal SCS, which are supplied to the pixel P for the first, second, and third periods t1_SM, t2_SM and t3_SM, and then supplies the generated data control signal DCS and the generated scan control signal SCS to the row driver 220 and the column driver 240. At the same time, the timing controller 210 generates pixel data for sensing, which is a bias voltage supplied to the gate electrode of the driving transistor Tdr, and then supplies the generated pixel data to the column driver 240. Also, the timing controller 210 generates a peak luminance data PLD, which set as a reference value for the sensing mode regardless of the input data Ri, Gi, and Bi, and then supplies the generated peak luminance data PLD to the reference gamma voltage supply 230. The reference gamma voltage supply 230 generates a plurality of reference gamma voltages RGV set at a reference voltage level per grayscale in accordance with the peak luminance data PLD and then supplies the generated reference gamma voltages RGV to the column driver 240.

For the first period t1_SM, the first switching transistor Tsw1 is turned on by the first scan pulse SP1 of high voltage, whereby the sensing data voltage Vdata_sen supplied to the data line DL is supplied to the first node n1, that is, the gate electrode of the driving transistor Tdr. In this period, the second switching transistor Tsw2 is also turned on by the second scan pulse SP2 of high voltage, whereby the pre-charging voltage Vpre supplied to the sensing line SL is supplied to the second node n2, that is, the source electrode of the driving transistor Tdr. At this time, the sensing data voltage Vdata_sen has a level of a target voltage set to sense a threshold voltage of the driving transistor Tdr. As a result, for the first period t1_SM, the source electrode of the driving transistor Tdr and the sensing line SL are reset to the pre-charging voltage Vpre.

Then, for the second period t2_SM, since the turn-on state of the first switching transistor Tsw1 is maintained by the first scan pulse SP1 of high voltage, the gate voltage of the driving transistor Tdr is fixed to the voltage level of the sensing data voltage Vdata_sen. At this time, the sensing line SL becomes a floating state by switching of the switching unit 244 in the column driver 240. As a result, the driving transistor Tdr is operated in a saturation driving mode by the sensing data voltage Vdata_sen, which is a bias voltage supplied to the gate electrode. For this reason, a difference voltage Vdata-Vth between the sensing data voltage Vdata_sen and the threshold voltage Vth of the driving transistor Tdr is charged in the sensing line SL of the floating state.

Then, for the third period t3_SM, the first switching transistor Tsw1 is turned off by the first scan pulse SP1 of low voltage, and the turn-on state of the second switching transistor Tw2 is maintained by the second scan pulse SP2 of high voltage. The sensing line SL is connected to the sensing unit 246 by switching of the switching unit 244. As a result, the sensing unit 246 senses the voltage Vsen of the sensing line SL, generates sensing data Sdata by performing an analog-to-digital conversion of the sensed voltage Vsen, that is, the threshold voltage of the driving transistor Tdr, and then provides the generated sensing data Sdata to the timing controller 210.

After sensing the threshold voltage of the driving transistor Tdr of each pixel P through the sensing mode, the timing controller 210 may again perform the sensing mode for sensing the mobility of the driving transistor Tdr of each pixel P. In this case, the timing controller 210 performs the aforementioned sensing mode or a similar sensing mode again, and controls the row driver 220 and the data driver 242 to supply the sensing data voltage Vdata_sen for the first period t1_SM only. Accordingly, when the sensing mode is again performed, for the second period t2_SM, the gate-source voltage of the driving transistor Tdr is increased by the first switching transistor Tsw1 being turned off, whereby the gate-source voltage of the driving transistor Tdr is maintained by the charged voltage of the capacitor Cst. As a result, the voltage corresponding to the flowing current of the driving transistor Tdr, that is, the voltage corresponding to the mobility of the driving transistor Tdr, is charged in the floated sensing line SL. Also, when the sensing mode is again performed, the sensing unit 246 converts the voltage charged in the sensing line SL, that is, the voltage corresponding to the mobility of the driving transistor Tdr, to the sensing data Sdata and then provides the converted sensing data to the timing controller 210.

Figure 6:
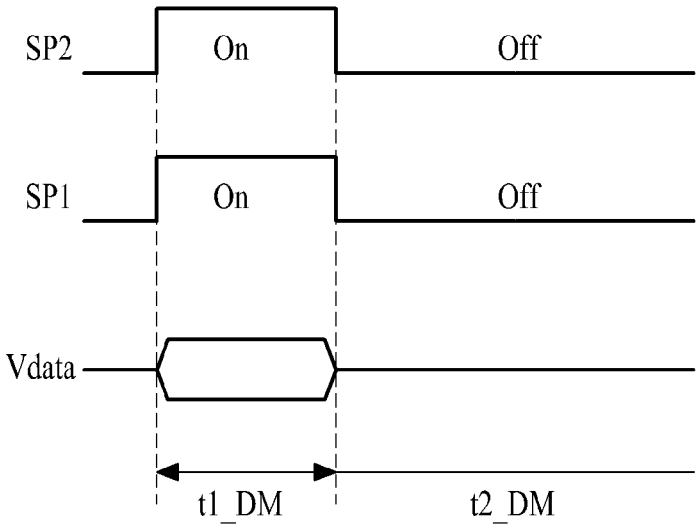
FIG. 6 is a waveform diagram illustrating a driving waveform during a display mode of an organic light emitting display device according to the example embodiment of the present invention.

FIG. 6 is a waveform diagram illustrating an example driving waveform during a display mode of an organic light emitting display device according to the example embodiment of the present invention.

As shown in FIGS. 2 to 4 and FIG. 6, during the display mode, the timing controller 210 generates the data control signal DCS and the scan control signal SCS, which are supplied to drive the pixel P for an addressing period t1_DM and a light emitting period t2_DM. The timing controller 210 then supplies the generated data control and scan control signals DCS and SCS to the row driver 220 and the column driver 240, respectively. At the same time, the timing controller 210 generates a corrected data DATA by correcting the input data Ri, Gi and Bi of the input images as described above on the basis of the sensing data Sdata, sensed during the sensing mode, and then provides the generated corrected data DATA to the column driver 240. The timing controller 210 also generates a peak luminance data PLD and supplies the generated peak luminance data PLD to the reference gamma voltage supply 230. The reference gamma voltage supply 230 generates a plurality of reference gamma voltages RGV varied based on the peak luminance data PLD and then supplies the generated reference gamma voltages RGV to the column driver 240. In this case, a compensation value for compensating for some of the characteristic variations of the driving transistor Tdr is reflected in the reference gamma voltages, and a compensation value for compensating the other characteristic variations of the driving transistor Tdr is reflected in the corrected data DATA.

First, for the addressing period t1_DM, the first switching transistor Tsw1 is turned on by the first scan pulse SP1 of high voltage, whereby the data voltage Vdata supplied to the data line DL is supplied to the first node n1, that is, the gate electrode of the driving transistor Tdr. In this addressing period, the second switching transistor Tsw2 is turned on by the second scan pulse SP2 of high voltage, whereby the reference voltage Vref supplied to the sensing line SL is supplied to the second node n2, that is, the source electrode of the driving transistor Tdr, in accordance with the switching of the switching unit 244. As a result, the capacitor Cst connected between the first node n1 and the second node n2 is charged by a difference voltage Vdata-Vref between the data voltage Vdata and the reference voltage Vref. In this case, the data voltage Vdata charged in the capacitor Cst incorporates a voltage for compensating for the threshold voltage of the corresponding driving transistor Tdr.

Then, for the light emitting period t2_DM, the first switching transistor Tsw1 is turned off by the first scan pulse SP1 of low voltage, and the second switching transistor Tsw2 is turned off by the second scan pulse SP2 of low voltage, whereby the driving transistor Tdr is turned on by the voltage Vdata-Vref stored in the capacitor Cst. Accordingly, the driving transistor Tdr, which is turned on, supplies a data current Ioled determined by the difference voltage Vdata-Vref to the organic light emitting device OLED, whereby the organic light emitting device OLED emits light in proportion to the data current Ioled flowing from the first driving power line PL to the second driving power line. In other words, for the light emitting period t2_DM, when the first and second switching transistors Tsw1 and Tsw2 are turned off, the current flows to the driving transistor Tdr, and the organic light emitting device OLED starts to emit light in proportion to the current, whereby the voltage of the second node n2 is increased. The voltage of the first node n1 is increased by the capacitor Cst as much as the increased voltage of the second node n2, whereby the gate-source voltage of the driving transistor Tdr is sustained by the voltage of the capacitor Cst, and the organic light emitting device OLED maintains the emission of light until the addressing period t1_DM of next frame. In this case, the current flowing to the organic light emitting device OLED is not affected by the threshold voltage of the driving transistor Tdr due to the compensation voltage incorporated in the data voltage Vdata as described above.

In the aforementioned organic light emitting display device according to the example embodiment of the present invention, the structure of the pixel P formed in the display panel 100 and the method for driving the pixel P in accordance with the sensing mode or the display mode are not limited to the example embodiment shown in FIGS. 3 to 6, and may be applied to any other organic light emitting display devices, which include a pixel structure capable of sensing one or more characteristic variations of the driving transistor in the pixel P through a sensing line, without departing from the spirit or scope of the present invention. For example, the pixel structure and the sensing method according to the present invention may be modified to apply to those disclosed in Korean laid-open Patent Nos. 10-2009-0046983 (US 2009/0140959), 10-2010-0047505, 10-2011-0057534 (US 2011/0122119), 10-2012-0045252, 10-2012-0076215, 10-2013-0066449 (US 2013/0147694), 10-2013-0066450 (US 2013/0147690), 10-2013-00741473, and Korean Registered Patent No. 10-0846790 or 10-1073226 (US2011/0227505).

Figure 7:
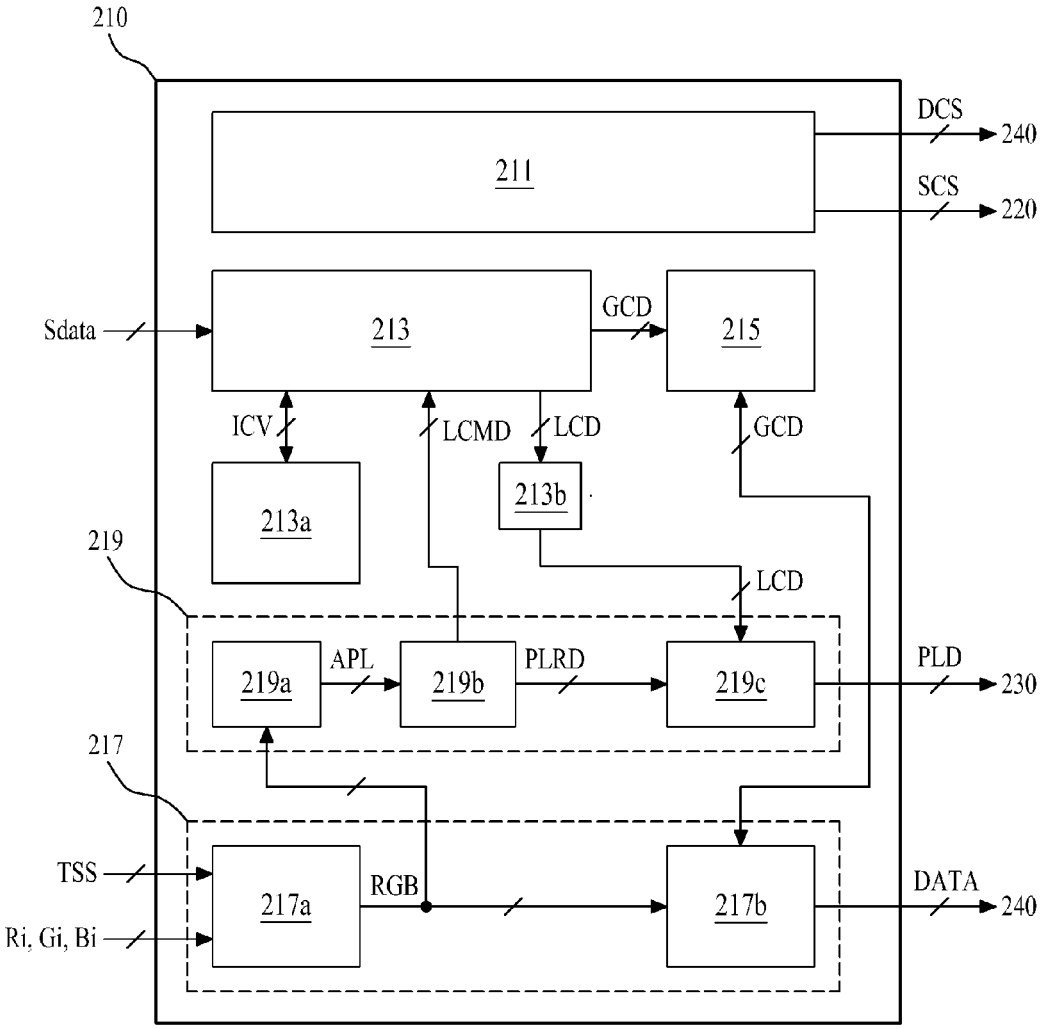
FIG. 7 is a block diagram illustrating an example timing controller according to one example embodiment of the present invention, which is shown in FIG. 2.

FIG. 7 is a block diagram illustrating a timing controller according to one example embodiment of the present invention, which is shown in FIG. 2.

As shown in FIG. 7 in conjunction with FIGS. 2 to 4, the timing controller 210 according to one example embodiment of the present invention includes a control signal generator 211, a sensing data processor 213, a memory 215, a data processor 217, and a peak luminance controller 219.

The control signal generator 211 generates a scan control signal SCS for controlling the row driver 220 and a data control signal DCS for controlling the column driver 240 on the basis of a timing synchronization signal TSS, which may include a vertical synchronization signal, a horizontal synchronization signal, a data enable signal, and a main clock.

The sensing data processor 213 receives sensing data Sdata of each pixel P provided from the column driver 240 when each pixel P is driven based on the sensing mode, and generates a luminance compensation data LCD and a grayscale compensation data GCD on the basis of the received sensing data Sdata of each pixel P. Hereinafter, the process of generating the luminance compensation data LCD and the grayscale compensation data GCD in the sensing data processor 213 will be described in more detail.

First, the sensing data processor 213 calculates a sensing compensation value of each pixel P, which is intended to compensate for one or more characteristic variations of the driving transistor Tdr included in each pixel P, on the basis of the sensing data Sdata of each pixel P.

Then, the sensing data processor 213 reads an initial compensation value ICV of each pixel P stored in a read only memory 213*a* and compares the read initial compensation value ICV of each pixel P with its corresponding sensing compensation value to calculate a compensation value deviation of each pixel P. In this case, the initial compensation value ICV of each pixel P may be set to remove characteristic variations of the driving transistors Tdr in all of the pixels P on the basis of the sensing data Sdata of the driving transistor Tdr in each pixel P sensed by the sensing mode performed during the manufacture or testing of the organic light emitting display device.

Figure 8:
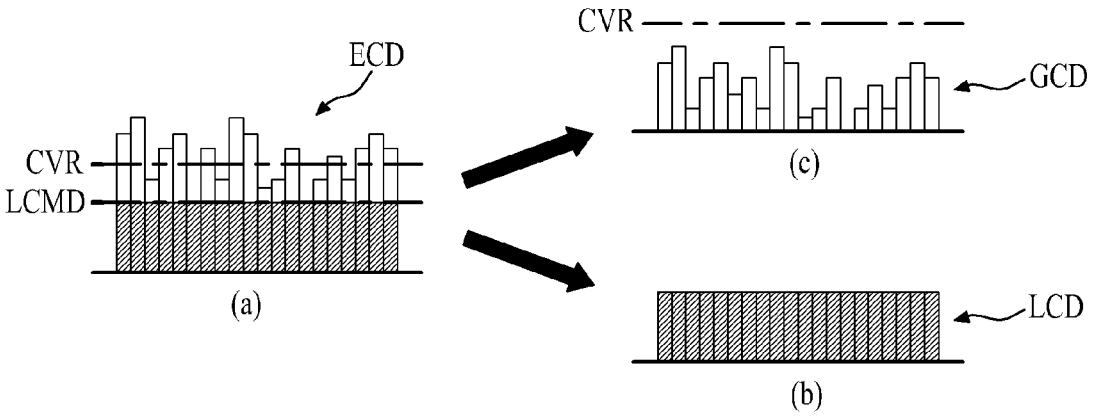
FIG. 8 is a diagram illustrating an example process of generating a luminance compensation data and a grayscale compensation data in a sensing data processor shown in FIG. 7.

Then, the sensing data processor 213 generates an external compensation data ECD of each pixel P, as shown in graph (a) of FIG. 8, by adding up the initial compensation value ICV of each pixel P and a compensation value deviation corresponding to the initial compensation value ICV.

Then, the sensing data processor 213 calculates a luminance compensation margin data LCMD from the external compensation data ECD of all the pixels P as shown in graph (a) of FIG. 8 and then generates common compensation data below the luminance compensation margin data LCMD as the luminance compensation data LCD as shown in graph (b) of FIG. 8. In this case, the common compensation data (or the luminance compensation data LCD) is calculated as the minimum external compensation data among the external compensation data ECD of all the pixels P. The luminance compensation data LCD may be provided to the peak luminance controller 219, or may be stored in an inner register or inner memory 213*b* and then provided to the peak luminance controller 219.

Then, the sensing data processor 213 calculates a grayscale compensation data GCD of each pixel P by subtracting the grayscale value of the luminance compensation data LCD from the grayscale value of the external compensation data ECD of each of the pixels P as shown in graph (c) of FIG. 8. The sensing data processor 213 then stores the calculated grayscale compensation data GCD of each pixel P in the memory 215. As a result, the grayscale compensation data of each pixel P stored in the memory 215 is updated to new grayscale compensation data GCD for each horizontal line of pixels.

The aforementioned sensing data processor 213 extends a compensation range of the grayscale compensation data GCD by as much as the luminance compensation data LCD reflected in the peak luminance by allocating some portion of the external compensation data ECD of each pixel P as the luminance compensation data LCD for being reflected in the peak luminance of the input image as shown in FIG. 8. As a result, the sensing data processor 213 enables a better external compensation for the characteristic variation of the driving transistor by using the grayscale compensation data GCD even in the event that the external compensation data ECD determined based on the sensed characteristic variation of the driving transistor exceeds the compensation voltage range CVR.

As shown in FIG. 7, the data processor 217 aligns input image data Ri, Gi and Bi from an external driving system (or graphic card) to correspond to a pixel arrangement structure of the display panel 100, and generates corrected data DATA by incorporating the grayscale compensation data GCD of each pixel P stored in the memory 215 in the aligned data RGB of each pixel P. To this end, the data processor 217 according to one example embodiment may include a data aligner 217*a* and a data corrector 217*b*.

The data aligner 217*a* generates aligned data RGB of each pixel P by aligning the input image data Ri, Gi and Bi to correspond to the pixel arrangement structure of the display panel 100.

The data corrector 217*b* reads the grayscale compensation data GCD corresponding to each pixel P from the memory 215, and generates the corrected data DATA for the pixel by adding the read grayscale compensation data GCD to the aligned data RGB of the corresponding pixel, which are supplied from the data aligner 217*a*.

The peak luminance controller 219 calculates a frame representative value APL by analyzing grayscale values of the input image data Ri, Gi and Bi and generates a peak luminance data PLD on the basis of the calculated frame representative value APL and the luminance compensation data LCD provided from the sensing data processor 213. To this end, the peak luminance controller 219 according to one example embodiment may include a representative value calculator 219*a*, a peak luminance set-up unit 219*b*, and a peak luminance data generator 219*c*.

The representative value calculator 219*a* calculates the frame representative value APL by analyzing the grayscale values of the input image data Ri, Gi and Bi input in a unit of frame. For example, the frame representative value APL may be an average grayscale value obtained by averaging the grayscale values of the input image data Ri, Gi and Bi of one frame. For another example, the frame representative value APL may be an average grayscale value obtained by calculating the maximum grayscale value per unit pixel from the input image data Ri, Gi and Bi of each unit pixel and then averaging the maximum grayscale values of all the unit pixels.

Figure 9:
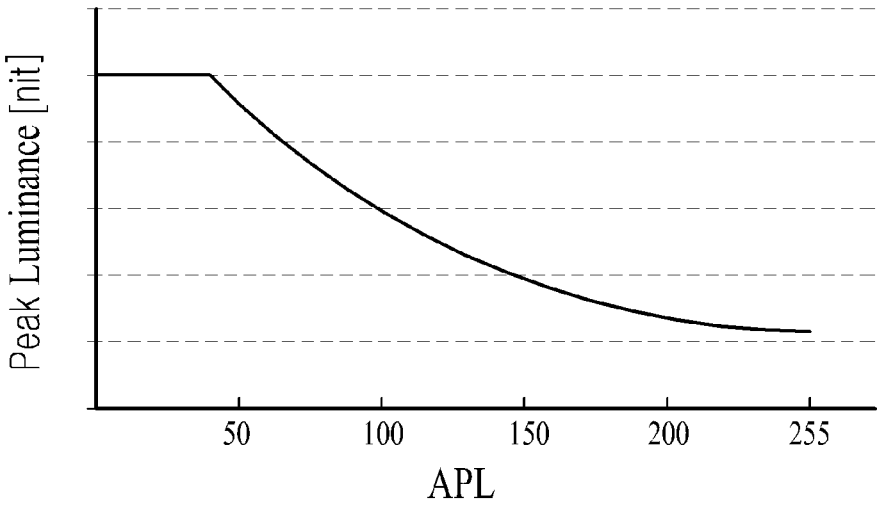
FIG. 9 is a graph illustrating a peak luminance curve for controlling peak luminance of input video for a frame representative value in an example embodiment of the present invention.

The peak luminance setup unit 219*b* generates a peak luminance reference data PLRD for limiting the peak luminance of the display panel 100 on the basis of the frame representative value APL supplied from the representative value calculator 219*a*. For example, the peak luminance setup unit 219*b* may generate the peak luminance reference data PLRD corresponding to the frame representative value APL supplied from the representative value calculator 219*a* on the basis of a peak luminance curve of a peak luminance value to the frame representative value APL as shown in FIG. 9. In this case, the peak luminance setup unit 219*b* may generate the peak luminance reference data PLRD based on the frame representative value APL by using a look-up table (not shown) for controlling the peak luminance to which the peak luminance reference data PLRD to the frame representative value APL is mapped, like the peak luminance curve.

Also, the peak luminance setup unit 219*b* generates the luminance compensation margin data LCMD on the basis of the peak luminance reference data PLRD and provides the generated luminance compensation margin data LCMD to the sensing data processor 213. More specifically, the maximum luminance value and its corresponding maximum voltage for controlling the peak luminance are allocated to the organic light emitting display device to correspond to the maximum luminance which may be obtained. Accordingly, the peak luminance setup unit 219*b* calculates a voltage margin between the peak luminance voltage set in accordance with the peak luminance reference data PLRD and the maximum available voltage for peak luminance, and generates the luminance compensation margin data LCMD corresponding to the calculated voltage margin. For example, in the event that the maximum available voltage for controlling peak luminance is 10V and the peak luminance voltage is set to 8V in accordance with the peak luminance reference data PLRD, the peak luminance setup unit 219*b* may calculate a voltage margin of 2V, which is the difference between the maximum voltage for controlling peak luminance and the peak luminance voltage, and may generate a grayscale value corresponding to 2V as the luminance compensation margin data LCMD. In other words, in this example, the luminance compensation margin data LCMD represents the available voltage margin (2V) below the maximum possible voltage (10 V) for peak luminance.

As shown in FIG. 7, the peak luminance data generator 219*c* generates peak luminance data PLD for limiting the peak luminance of the input image by correcting the peak luminance reference data PLRD provided from the peak luminance setup unit 219*b* on the basis of the luminance compensation data LCD provided from the sensing data processor 213. For example, the peak luminance data generator 219*c* may generate the peak luminance data PLD by adding the luminance compensation data LCD to the peak luminance reference data PLRD. The luminance compensation data LCD may be the lower of the luminance compensation margin data LCMD and the lowest ECD value among all the pixels in a given horizontal line or frame.

The peak luminance data PLD is supplied to the aforementioned reference gamma voltage supply 230. The reference gamma voltage supply 230 generates a plurality of reference gamma voltages RGV varied in accordance with the peak luminance data PLD and provides the generated reference gamma voltages RGV to the column driver 240.

The peak luminance controller 219 extends the compensation range of the grayscale compensation data GCD for compensating for one or more characteristic variations of the driving transistor Tdr of each pixel P by controlling the peak luminance of the input image on the basis of some of the external compensation data for compensating for the characteristic variations of the driving transistor Tdr included in each pixel, as well as on the basis of the frame representative value APL calculated from the input image data Ri, Gi and Bi. As a result, even in the event that input images having the same frame representative value are displayed in the display panel 100 over a plurality of frames, the peak luminance controller 219 varies the peak luminance of the input images. For example, if the peak luminance controller 219 controls the peak luminance of the input images by using the frame representative value, since the peak luminance controller 219 generates the same peak luminance data PLD per frame in accordance with the same frame representative value, the reference gamma voltage RGV output from the reference gamma voltage supply 230 is not varied, whereby the peak luminance of the input images is not varied. On the other hand, if the peak luminance controller 219 controls the peak luminance of the input images by using the frame representative value and the aforementioned grayscale compensation data GCD, since the peak luminance controller 219 generates the same peak luminance reference data PLRD per frame in accordance with the same frame representative value and generates the peak luminance data PLD by correcting the generated peak luminance reference data PLRD in accordance with the luminance compensation data LCD, the reference gamma voltage RGV output from the reference gamma voltage supply 230 is varied, whereby peak luminance of the input images is varied.

Figure 10:
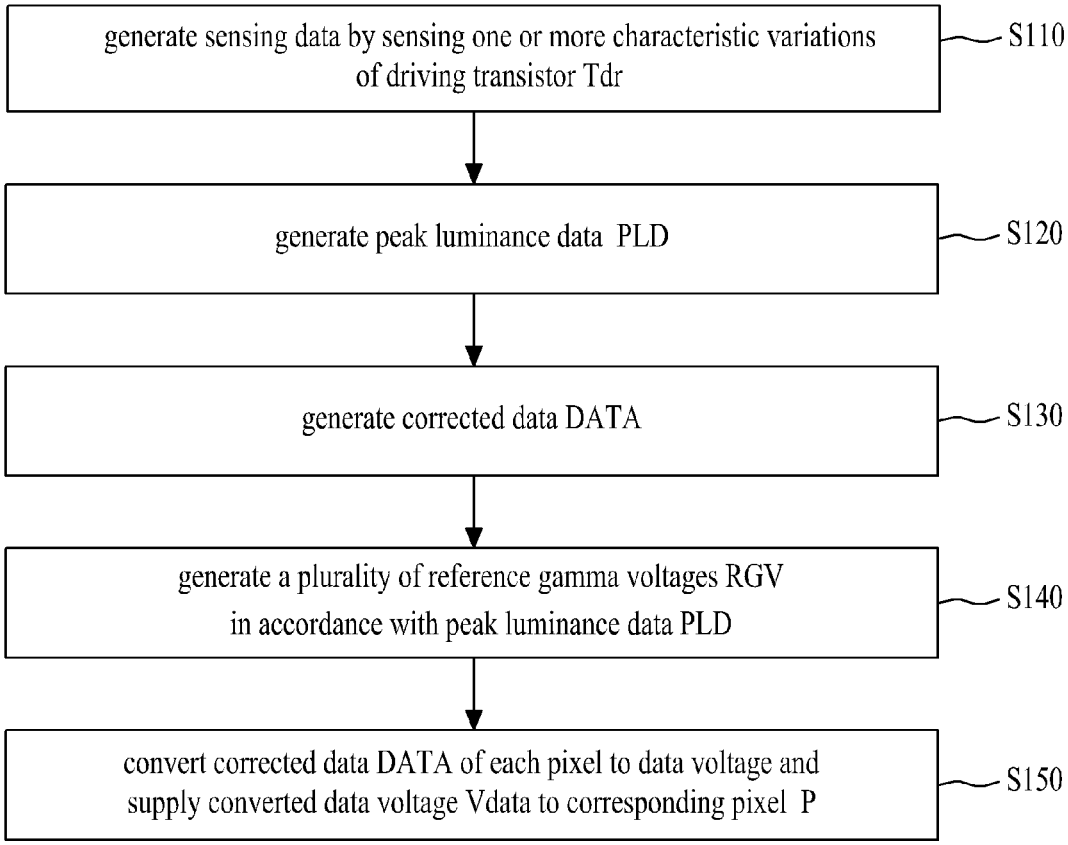
FIG. 10 is a flow chart illustrating a method for driving an organic light emitting display device according to the example embodiment of the present invention.

FIG. 10 is a flow chart illustrating a method for driving an organic light emitting display device according to an example embodiment of the present invention.

The method for driving an organic light emitting display device according to the example embodiment of the present invention illustrated in FIG. 10 will be described in conjunction with FIGS. 2 and 7.

First, one or more characteristic variations of the driving transistor Tdr included in each pixel P is sensed through each of the plurality of sensing lines SL, whereby sensing data Sdata are generated (S110). In this case, the sensing data Sdata are generated by driving each pixel P in accordance with the sensing mode as described above with reference to FIG. 5. The description is not repeated here.

Then, peak luminance data PLD for limiting the peak luminance of input images are generated on the basis of a frame representative value APL calculated by analysis of input data Ri, Gi and Bi corresponding to the input images and the sensing data Sdata (S120). Hereinafter, the process of generating the peak luminance data PLD will be described in more detail.

First, a sensing compensation value of each pixel P is calculated on the basis of the sensing data Sdata of each pixel P. An external compensation data of each pixel P is calculated on the basis of an initial compensation value of the driving transistor Tdr of each pixel P, which is stored in the read only memory 213*a*, and the sensing compensation value corresponding to the initial compensation value. Subsequently, after the frame representative value APL is calculated by analysis of the input data Ri, Gi and Bi of one frame, the peak luminance reference data PLRD corresponding to the frame representative value APL is generated, and the luminance compensation margin data LCMD is generated on the basis of the peak luminance reference data PLRD. The luminance compensation data LCD and grayscale compensation data GCD are generated from the external compensation data of each pixel on the basis of the luminance compensation margin data LCMD. Subsequently, the peak luminance reference data PLRD is corrected in accordance with the luminance compensation data LCD, whereby the peak luminance data PLD is generated. In this case, the luminance compensation data LCD may be comprised of common data below the luminance compensation margin data LCMD among the external compensation data ECD of all the pixels P. Also, the grayscale compensation data GCD may be generated as an external compensation data of each pixel P, where the grayscale value of the grayscale compensation data GCD represents the difference between the grayscale values of the external compensation data ECD and the luminance compensation data LCD. Then, the grayscale compensation data GCD of each pixel P may be stored in the memory 215.

Next, the input data Ri, Gi and Bi are corrected on the basis of the sensing data Sdata and the peak luminance of the input images, whereby corrected data DATA are generated. In other words, the corrected data DATA are generated based on the grayscale compensation data GCD of each pixel P, which are stored in the memory 215, and their corresponding input data Ri, Gi and Bi of each pixel (S130).

Then, a plurality of reference gamma voltages RGV are generated on the basis of the peak luminance data PLD (S140).

Then, the corrected data DATA is converted to a data voltage Vdata based on the plurality of reference gamma voltages RGV, whereby the converted data voltage Vdata is supplied to its corresponding pixel P (S150).

In the aforementioned organic light emitting display device according to the example embodiment of the present invention and the method for driving the same, some of the external compensation data ECD for compensating for the characteristic variations of the driving transistor Tdr included in each pixel P may be reflected in the peak luminance data PLD for controlling peak luminance of the input images, whereby the compensation range of the compensation data for compensating for the characteristic variations of the driving transistor Tdr may be extended.

As described above with respect to the example embodiments of the present invention, the compensation range of the external compensation data for compensating for the characteristic variations of the driving transistor included in each pixel may be extended. Thus, the display device according to the example embodiments of the present invention and the method of driving the same can compensate for the degradation of the driving transistor caused by being driven for a long period of time.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting display device, comprising:

a display panel including a plurality of pixels and a plurality of sensing lines respectively coupled to the pixels, each of the pixels including an organic light emitting device and a driving transistor to control a current flow in the organic light emitting device; and a panel driver configured:

to receive an input image data for at least one of the pixels, to generate a sensing data by sensing a characteristic variation of the driving transistor in the at least one of the pixels through a corresponding one of the sensing lines, to calculate a frame representative value by analyzing the input image data in a unit of one frame, to generate a peak luminance data to limit peak luminance of an input image based on the frame representative value, to generate a corrected data for the at least one of the pixels by correcting the input image data based on the sensing data, to convert the corrected data to a data voltage based on a plurality of reference gamma voltages set based on the peak luminance data, and to supply the data voltage to the at least one of the pixels.

2. The organic light emitting display device of claim 1, wherein the display panel further includes a plurality of scan lines respectively coupled to the pixels, and a plurality of sensing control lines respectively coupled to the pixels, and wherein the panel driver includes a row driver configured to receive a scan control signal, and configured to supply the first scan pulses to the scan lines and the second scan pulses to the sensing control lines based on the scan control signal.

3. The organic light emitting display device of claim 2, wherein the row driver includes:

a scan line driver coupled to the scan lines and configured to sequentially supply the first scan pulses to the scan lines; and a sensing line driver coupled to the sensing control lines and configured to sequentially supply the second scan pulses to the sensing control lines.

4. The organic light emitting display device of claim 1, wherein the display panel further includes a plurality of data lines respectively coupled to the pixels, and wherein a the panel driver includes a column driver configured to receive a data control signal and the corrected data, to generate the sensing data by sensing the characteristic variation of the driving transistor in the at least one of the pixels through the corresponding one of the sensing lines, to convert the corrected data to the data voltage based on the plurality of reference gamma voltages, and to supply the data voltage to the at least one of the pixels through the corresponding one of the data lines.

5. The organic light emitting display device of claim 1, wherein the panel driver includes a reference gamma voltage supply configured to generate the plurality of reference gamma voltages based on the peak luminance data.

6. The organic light emitting display device of claim 1, wherein the panel driver includes a timing controller configured to generate a scan control signal and a data control signal based on a timing signal, to generate the peak luminance data based on the input image data, and to generate the corrected data based on the sensing data.

7. The organic light emitting display device of claim 6, wherein the timing controller includes:

a control signal generator configured to generate the scan control signal and the data control signal;

a sensing data processor configured to generate a grayscale compensation data for the at least one of the pixels based on the sensing data;

a peak luminance controller configured to generate the peak luminance data based on the input image data; and a data processor configured to generate the corrected data for the at least one of the pixels based on the input image data and the grayscale compensation data.

8. The organic light emitting display device of claim 7, wherein the sensing data processor is configured to receive the sensing data and an initial compensation value of the at least one of the pixels from a memory, to determine an external compensation data for the at least one of the pixels based on the initial compensation value and the sensing data, to generate a luminance compensation data based on a luminance compensation margin data and the external compensation data, and to generate the grayscale compensation data for the at least one of the pixels based on the luminance compensation data and the external compensation data.

9. The organic light emitting display device of claim 8, wherein the sensing data processor is configured to receive the initial compensation value for each of the pixels and to determine the external compensation value for each of the pixels, wherein the luminance compensation data is the lower of the luminance compensation margin data and the lowest of the external compensation data among the pixels, and wherein the grayscale compensation data is the difference between a grayscale value of the luminance compensation data and a grayscale value of the external compensation data for the at least one of the pixels.

10. The organic light emitting display device of claim 8, wherein the peak luminance controller is configured to determine the frame representative value based on the input image data, to determine a peak luminance reference data based on the frame representative value, to generate the luminance compensation margin data based on the peak luminance reference data, and to generate the peak luminance data based on the peak luminance reference data and the luminance compensation data.

11. The organic light emitting display device of claim 10, wherein the luminance compensation margin data is a grayscale value of a voltage difference between a maximum available voltage for controlling peak luminance and a peak luminance voltage set based on the peak luminance reference data.

12. The organic light emitting display device of claim 7, wherein the data processor is configured to determine an aligned data of the at least one of the pixels by aligning the input image data to correspond to a pixel arrangement structure of the display panel, and to determine the corrected data for the at least one of the pixels by adding the grayscale compensation data to the aligned data.

13. An organic light emitting display device, comprising:

a display panel including a plurality of scan lines, a plurality of data lines crossing the scan lines, a plurality of pixels at the crossings of the scan lines and data lines, and a plurality of sensing lines respectively coupled to the pixels, at least one of the pixels including an organic light emitting device and a driving transistor to control a current flow in the organic light emitting device;

a timing controller configured to generate a scan control signal and a data control signal, and configured to receive an input image data for the at least one of the pixels and a sensing data for the at least one of the pixels, to calculate a frame representative value by analyzing the input image data in a unit of one frame, to generate a peak luminance data based on the frame representative value, and to generate a corrected data for the at least one of the pixels based on the sensing data;

a row driver configured to supply first scan pulses to the scan lines and second scan pulses to the sensing control lines based on the scan control signal;

a reference gamma voltage supply configured to generate the plurality of reference gamma voltages based on the peak luminance data; and a column driver coupled to the data lines and sensing lines, and configured to generate the sensing data by sensing the characteristic variation of the driving transistor in the at least one of the pixels through a corresponding one of the sensing lines, to convert the corrected data to the data voltage based on the plurality of reference gamma voltages, and to supply the data voltage to the at least one of the pixels through the corresponding one of the data lines.

14. The organic light emitting display device of claim 13, wherein the timing controller includes:

a control signal generator configured to generate the scan control signal and the data control signal;

a sensing data processor configured to generate a grayscale compensation data for the at least one of the pixels based on the sensing data;

a peak luminance controller configured to calculate a frame representative value by analyzing the input image data in a unit of one frame and to generate the peak luminance data based on the frame representative value; and a data processor configured to generate the corrected data for the at least one of the pixels based on the input image data and the grayscale compensation data.

15. The organic light emitting display device of claim 14, wherein the sensing data processor is configured to receive an initial compensation value of the at least one of the pixels from a memory, to determine an external compensation data for the at least one of the pixels based on the initial compensation value and the sensing data, to generate a luminance compensation data based on a luminance compensation margin data and the external compensation data, and to generate the grayscale compensation data for the at least one of the pixels based on the luminance compensation data and the external compensation data.

16. The organic light emitting display device of claim 15, wherein the sensing data processor is configured to receive the initial compensation value for each of the pixels and to determine the external compensation value for each of the pixels, wherein the luminance compensation data is the lower of the luminance compensation margin data and the lowest of the external compensation data among the pixels, and wherein the grayscale compensation data is the difference between a grayscale value of the luminance compensation data and a grayscale value of the external compensation data for the at least one of the pixels.

17. The organic light emitting display device of claim 15, wherein the peak luminance controller is configured to determine a peak luminance reference data based on the frame representative value, to generate the luminance compensation margin data based on the peak luminance reference data, and to generate the peak luminance data based on the peak luminance reference data and the luminance compensation data.

18. The organic light emitting display device of claim 17, wherein the luminance compensation margin data is a grayscale value of a voltage difference between a maximum available voltage for controlling peak luminance and a peak luminance voltage set based on the peak luminance reference data.

19. The organic light emitting display device of claim 14, wherein the data processor is configured to determine an aligned data of the at least one of the pixels by aligning the input image data to correspond to a pixel arrangement structure of the display panel, and to determine the corrected data for the at least one of the pixels by adding the grayscale compensation data to the aligned data.

20. The organic light emitting display device of claim 13, wherein the row driver includes:

a scan line driver coupled to the scan lines and configured to sequentially supply the first scan pulses to the scan lines; and a sensing line driver coupled to the sensing control lines and configured to sequentially supply the second scan pulses to the sensing control lines.

21. A method for driving an organic light emitting display device including a plurality of pixels and a plurality of sensing lines respectively coupled to the pixels, each of the pixels including an organic light emitting device and a driving transistor for controlling a current flowing in the organic light emitting device, the method comprising:

generating a sensing data for at least one of the pixels by sensing a characteristic variation of the driving transistor of the at least one of the pixels through a corresponding one of the sensing lines;

calculating a frame representative value for the at least one of the pixels by analyzing input image data in a unit of one frame;

determining a peak luminance data to limit peak luminance of an input image based on the frame representative value and the sensing data;

determining a corrected data for the at least one of the pixels by correcting the input image data based on the sensing data;

generating a plurality of reference gamma voltages based on the peak luminance data;

converting the corrected data to a data voltage based on the plurality of reference gamma voltages; and supplying the data voltage to the at least one of the pixels.

22. The method of claim 21, wherein the determining of the corrected data includes:

determining a grayscale compensation data for the at least one of the pixels based on the sensing data; and calculating the corrected data based on the input image data and the grayscale compensation data.

23. The method of claim 22, wherein the determining of the grayscale compensation data includes:

receiving an initial compensation value of each of the pixels;

determining an external compensation data for each of the pixels based on the initial compensation value and the sensing data for the corresponding pixel;

determining a peak luminance reference data based on the frame representative value;

determining a luminance compensation margin data based on the peak luminance reference data;

determining a luminance compensation data based on the luminance compensation margin data and the external compensation data, and determining the grayscale compensation data based on the luminance compensation data and the external compensation data for the at least one of the pixels.

24. The method of claim 23, wherein the luminance compensation data is the lower of the luminance compensation margin data and the lowest of the external compensation data among the pixels, and wherein the grayscale compensation data is the difference between a grayscale value of the luminance compensation data and a grayscale value of the external compensation data for the at least one of the pixels.

25. The method of claim 23, wherein the determining of the peak luminance data includes determining the peak luminance data based on the peak luminance reference data and the luminance compensation data.

26. The method of claim 23, wherein the luminance compensation margin data is a grayscale value of a voltage difference between a maximum available voltage for controlling peak luminance and a peak luminance voltage set based on the peak luminance reference data.

27. The method of claim 22, wherein the calculating of the corrected data includes:

determining an aligned data of the at least one of the pixels by aligning the input image data to correspond to a pixel arrangement structure of the display panel; and determining the corrected data for the at least one of the pixels by adding the grayscale compensation data to the aligned data.

* * * * *